US009006695B2

(12) United States Patent
Lantheaume et al.

(10) Patent No.: US 9,006,695 B2
(45) Date of Patent: Apr. 14, 2015

(54) USE OF A MIXTURE COMPRISING ERBIUM AND PRASEODYMIUM AS A RADIATION ATTENUATING COMPOSITION, RADIATION ATTENUATING MATERIAL, AND ARTICLE PROVIDING PROTECTION AGAINST IONISING RADIATION AND COMPRISING SUCH A COMPOSITION

(71) Applicant: Areva NC, Courbevoie (FR)

(72) Inventors: Noël Lantheaume, Vallerargues (FR); Marc Pichegut, Saint Victor la Coste (FR); Jacky Jehanno, Gaujac (FR)

(73) Assignee: Areva NC, Courbevoie (FR)

( * ) Notice: Subject to any disclaimer, the term of this patent is extended or adjusted under 35 U.S.C. 154(b) by 0 days.

(21) Appl. No.: 14/369,357

(22) PCT Filed: Dec. 28, 2012

(86) PCT No.: PCT/EP2012/077037

§ 371 (c)(1),
(2) Date: Jun. 27, 2014

(87) PCT Pub. No.: WO2013/098382

PCT Pub. Date: Jul. 4, 2013

(65) Prior Publication Data

US 2014/0361199 A1 Dec. 11, 2014

(30) Foreign Application Priority Data

Dec. 30, 2011 (FR) ..... 11 04168

(51) Int. Cl.
*G21F 3/02* (2006.01)
*G21F 1/06* (2006.01)

(Continued)

(52) U.S. Cl.
CPC .. *G21F 1/06* (2013.01); *G21F 3/02* (2013.01); *G21F 3/035* (2013.01); *G21F 1/085* (2013.01)

(58) Field of Classification Search
CPC ..... G21F 1/085; G21F 1/125; G21F 1/106
USPC ..... 250/505.1, 515.1, 516.1, 518.1, 519.1
See application file for complete search history.

(56) References Cited

U.S. PATENT DOCUMENTS

| | | | | |
|---|---|---|---|---|
| 7,897,949 | B2 * | 3/2011 | Ballsieper | 250/515.1 |
| 2008/0128658 | A1 | 6/2008 | Jungermann et al. | |
| 2012/0217423 | A1 | 8/2012 | Larmigny et al. | |

FOREIGN PATENT DOCUMENTS

| | | | |
|---|---|---|---|
| DE | 102006028958 | A1 | 12/2007 |
| FR | 2 948 672 | A1 | 2/2011 |

(Continued)

OTHER PUBLICATIONS

International Search Report for PCT/EP2012/ 077037 dated May 23, 2013.

(Continued)

*Primary Examiner* — Michael Maskell
(74) *Attorney, Agent, or Firm* — Pearne & Gordon LLP

(57) ABSTRACT

The invention relates to the use of a mixture comprising erbium and praseodymium as a radiation attenuating composition, i.e. as a composition that can attenuate ionizing radiation, in particular X- and gamma-type electromagnetic radiation.

The invention also relates to a radiation attenuating material comprising an erbium- and praseodymium-based composition, as well as a protective article which provides group or individual protection against ionizing radiation and comprises said material.

The invention is suitable for use in nuclear medicine (scintigraphy, radiotherapy, etc.), radiology, medical imaging, the nuclear industry, etc.

23 Claims, 4 Drawing Sheets

(51) Int. Cl.
*G21F 3/035* (2006.01)
*G21F 1/08* (2006.01)

(56) References Cited

FOREIGN PATENT DOCUMENTS

| | | | |
|---|---|---|---|
| FR | 2948672 | A1 | 2/2011 |
| WO | 2004/055833 | A1 | 7/2004 |
| WO | 2005017556 | A2 | 2/2005 |
| WO | 2006069007 | A2 | 6/2006 |

OTHER PUBLICATIONS

Written Opinion for PCT/EP2012/ 077037, May 25, 2013.
Preliminary Search Report for FR 11 04168 dated Aug. 28, 2012.

* cited by examiner

USE OF A MIXTURE COMPRISING ERBIUM AND PRASEODYMIUM AS A RADIATION ATTENUATING COMPOSITION, RADIATION ATTENUATING MATERIAL, AND ARTICLE PROVIDING PROTECTION AGAINST IONISING RADIATION AND COMPRISING SUCH A COMPOSITION

TECHNICAL FIELD

The invention relates to the use of a mixture comprising erbium and praseodymium as a radiation attenuating composition, i.e. as a composition having the property of attenuating ionising radiation, in particular X- and gamma-type electromagnetic radiation.

It also relates to a radiation attenuating material comprising a radiation attenuating composition comprising erbium and praseodymium, as well as a protective article which provides individual or group protection against ionising radiation and comprises said material.

The invention finds application in all fields in which protection against ionising radiation may be sought and, in particular, in the fields of nuclear medicine (scintigraphy, radiotherapy, etc.), radiology, medical imaging, and the nuclear industry.

STATE OF THE PRIOR ART

In a certain number of professions, it is normal to use clothing and other articles to protect against ionising radiation.

This is particularly the case in the fields of medicine, radiology, or medical imaging, where ionising radiation is used for diagnostic and therapeutic purposes.

It is also the case in the plastic materials industry where irradiations are used to obtain chemical effects of polymerisation, grafting, cross-linking or degradation of polymers; in the nuclear industry, where operators are exposed to a risk of irradiation, particularly during the handling of powders of nuclear fuels or from the dismantling of facilities; or in inspection and control laboratories, for example of manufactured parts, where analytical techniques based on the use of ionising radiation are employed.

Most radiation protection articles currently available on the market comprise a matrix, the nature of which depends on the destination of said articles and which contain lead, either in the form of sheets, or in the form of fine particles, the lead then being able to be in the metal, oxide or salt state.

Given the toxicity of lead and compounds thereof, the manufacture of such protective articles requires heavy and costly equipment to prevent any contamination of the personnel in charge of this manufacture.

In addition, the elimination of waste from the manufacture of these articles as well as that of protective articles after use requires specific collection and treatment channels, failing which they are quite simply disposed of in discharges with all the harmful consequences on the environment which that can imply.

Also, it has recently been proposed to replace the use of lead as radiation attenuating agent by that of other metals which are also capable of attenuating ionising radiation but which are not toxic or, in any case, have lower toxicity than that of lead.

Thus, for example, PCT international application WO 2006/069007 [1] advocates using a radiation attenuating composition composed of a salt of elementary barium, tungsten and bismuth.

Patent application US 2008/0128658 [2] describes the use of a composition comprising the oxide of gadolinium $Gd_2O_3$, tungsten and one or more oxides of rare earths other than gadolinium, such as $LaO_3$, $CeO_2$, $Nd_2O_3$, $Pr_6O_{11}$, $Eu_2O_3$ and $Sm_2O_3$.

Patent application FR 2 948 672 [3] advocates the use of a composition composed of oxides of tungsten, bismuth and lanthanum.

PCT international application WO 2005/017556 [4] proposes using a composition comprising at least two elements selected from antimony, bismuth, iodine, tungsten, tin, tantalum, erbium, barium, salts, compounds and alloys thereof, whereas patent application DE 10 2006 958 [5] describes a multilayer radiation protection material, certain layers of which comprise a radiation attenuating element selected from tin, antimony, iodine, caesium, barium, lanthanum, cerium, praseodymium and neodymium, optionally associated with a second radiation attenuating element having, for its part, an atomic number ranging from 60 to 70.

Although it cannot be contested that erbium and praseodymium form part of the chemical elements that are cited in the aforementioned references [2], [4] and [5] as being capable of being used in radiation attenuating compositions, it turns out that nothing is said in these references on the real capacities of these two elements, taken separately or in combination, to attenuate ionising radiation.

Yet, it turns out that, within the scope of their works, the inventors have observed that a mixture comprising erbium or a compound thereof and praseodymium or a compound thereof has particularly interesting radiation attenuation properties, and that these properties may advantageously be harnessed to form materials and protective articles able to assure very efficient protection against ionising radiation, in particular X- and gamma-type electromagnetic radiation.

It is on the basis of this observation that the invention is based.

DESCRIPTION OF THE INVENTION

The subject-matter of the invention is thus, firstly, the use of a mixture comprising:

30 to 70% by mass of erbium or of a compound thereof;

20 to 50% by mass of praseodymium or of a compound thereof; and 0 to 50% by mass of bismuth or of a compound thereof; as a radiation attenuating composition.

The basis of the principle of radiation attenuation implemented within the scope of the invention is an interaction that takes place between, on the one hand, the photons from an ionising radiation and, on the other hand, at least one radiation attenuating chemical element, the latter absorbing part of the energy of said photons.

This ionising radiation may be a gamma-type electromagnetic radiation, when this is emitted by one or more radioactive atoms during their disintegration.

This ionising radiation may also be an X-type electromagnetic radiation, when this is produced by an X-ray generator, within which a potential difference ranging usually from several tens to several hundreds of kilovolts (kV) is applied.

The probability and the intensity of this interaction are closely linked to various parameters, such as the nature of the radiation attenuating chemical element, the binding forces between the atomic nucleus of said element and the different shells of its electron cloud, or the energy of the ionising radiation.

In concrete terms, the capacity of a chemical element to attenuate radiation may be measured by a mass attenuation coefficient, which is proportional to this probability of interaction, this also being known as "cross-section".

Thus, the higher the cross-section the greater the attenuation. For a same element of the periodic table of elements, the cross-section exhibits discontinuities linked to the binding energies of the different electron shells of this element.

The phenomenon of absorption of a photon (gamma or X) by the radiation attenuating chemical element is observed when the energy of the photon is substantially greater than the binding energy of one of the electrons of said chemical element. This phenomenon increases significantly when the energy of said photon is sufficiently high to expulse an electron from a deeper electron shell of the radiation attenuating chemical element.

The inventors have thus been able to demonstrate, as is explained hereafter, the existence, for erbium and compounds thereof, of an absorption maximum for a photonic energy of the order of 60 kiloelectron-volts (keV). This absorption maximum is, moreover, greater than that measured for lead at the same energy.

The interaction between the photons from the ionising radiation and the radiation attenuating chemical element, as we have described above, can take place according to several effects, such as the photoelectric effect, the Compton effect or the materialization effect. The preponderant effects are closely linked to the atomic number of the chemical element that undergoes the absorption, but also to the energy of the absorbed radiation.

In the case of erbium, element of atomic number 68, subjected to an ionising radiation of 60 keV, the interaction mainly takes place according to the photoelectric effect, which signifies that each of the photons of the ionising radiation is absorbed while expelling an electron from one of the electron shells of the atom of erbium. This subsequently reorganizes the electron vacancy created, and restores the energy acquired by emitting one or more photons.

Thus, for this element, these photons constitute the basis of an X-type secondary radiation, of energy mainly centred on 52 keV.

The inventors have thus been able to demonstrate that erbium and compounds thereof, particularly oxides thereof, turn out to be particularly efficient in the radiation attenuation field, when they are subjected to an ionising radiation, for example an X- or gamma-type electromagnetic radiation, of energy mainly centred on 60 keV.

Energy "mainly centred" on 60 keV is taken to mean an energy for which a proportion greater than or equal to 80% of the distribution of photons of an energy spectrum, which corresponds to this radiation, has an energy equal to 60 keV.

This type of radiation may, for example, come from X-ray generators within which a potential difference, ranging for example from 80 to 150 kV, is applied.

In particular, for potential differences of 80 and 140 kV, the inventors have in particular been able to demonstrate the existence of a high distribution of photons having an energy approximately equal to 60 keV.

This type of radiation may further be the main radiation emitted by a nuclear fuel, for example MOX (constituted of a mixture of oxides of plutonium and uranium), for which this main radiation corresponds to the emission of a gamma photon by americium-241, obtained itself by $\beta^-$ disintegration of radioactive plutonium-241.

The existence of an X-type secondary electromagnetic radiation, as described previously, has also been taken into consideration by the inventors.

Consequently, and according to the invention, the erbium or the erbium compound is used, in the radiation attenuating composition, in combination with praseodymium or a compound thereof.

In fact, by using a radiation attenuating composition associating erbium or a compound thereof with praseodymium or a compound thereof, the inventors have thus been able to demonstrate, as will be shown hereafter, the existence of two absorption maxima:

- thanks to the erbium or to the compound thereof, for example sesquioxide of erbium(III), an absorption maximum for a photonic energy of the order of 60 keV; and
- thanks to the praseodymium or to the compound thereof, for example oxide of praseodymium(III-IV), another absorption maximum for a photonic energy of the order of 45 keV, corresponding to the energy of the X-type secondary radiation emitted by erbium, which has been described previously.

The erbium compound is, preferably, an erbium oxide and, even more preferably, sesquioxide of erbium(III), of formula $Er_2O_3$, whereas the praseodymium compound is, preferably, a praseodymium oxide and, even more preferably, an oxide selected from oxide of praseodymium(III), oxide of praseodymium(IV) and oxide of praseodymium(III-IV), of respective formulas $Pr_2O_3$, $PrO_2$ and $Pr_6O_{11}$. Oxide of praseodymium(III-IV) is quite particularly preferred.

When the radiation attenuating composition according to the invention comprises such oxides of erbium and of praseodymium, it comprises, preferably, 55 to 65% by mass of erbium oxide and 35 to 45% by mass of praseodymium oxide; better still, the radiation attenuating composition comprises (60±2) % by mass of erbium oxide and (40±2) % by mass of praseodymium oxide.

Furthermore, the inventors have also been able to show that the protection spectrum conferred by a radiation attenuating composition, which comprises erbium or a compound thereof and praseodymium or a compound thereof, may be further widened by using them jointly with bismuth or a compound thereof.

Also, according to a particularly preferred disposition of the invention, the erbium or the erbium compound and the praseodymium or the praseodymium compound are used within the radiation attenuating composition, jointly with at least bismuth, introduced in elementary form or in the form of a compound, for example the sesquioxide of bismuth(III), of formula $Bi_2O_3$, in proportions that depend in particular on the energy of the ionising radiation received by the radiation attenuating composition thereby constituted.

Thus, by using a radiation attenuating composition associating erbium or a compound thereof, praseodymium or a compound thereof and bismuth or a compound thereof, the inventors have been able to demonstrate, as will be shown hereafter, the existence of three absorption maxima:

- thanks to the erbium or to the erbium compound, for example sesquioxide of erbium(III), an absorption maximum for a photonic energy of the order of 60 key;
- thanks to the praseodymium or to the praseodymium compound, for example oxide of praseodymium(III-IV), an absorption maximum for a photonic energy of the order of 45 key;
- finally, thanks to the bismuth or to the bismuth compound, an absorption maximum for a photonic energy of the order of 90 keV, to which very satisfactory radiation attenuation properties, for ionising radiation having photonic energies of the order of 40 keV and less, are added.

Moreover, it may be noted that the use of a composition associating erbium or a compound thereof, praseodymium or a compound thereof and bismuth or a compound thereof enables the attenuation of an ionising radiation having a wide energy range, for example comprised between 0 and 100 keV, the radiation attenuation properties of each of said three elements being not discrete but continuous.

Preferably, the bismuth is used in elementary form.

Also preferably, when bismuth is present in the radiation attenuating composition, the latter comprises 30 to 45% by mass of erbium oxide, 20 to 30% by mass of praseodymium oxide and 30 to 45% by mass of bismuth; better still, it comprises 33 to 42% and, in a particularly preferred manner, (36±2) % by mass of erbium oxide, 22 to 28% and, in a particularly preferred manner, (24±2) % by mass of praseodymium oxide, and 30 to 45% and, in a particularly preferred manner, (40±2) % by mass of bismuth.

In a variant, it is also possible to associate erbium or the compound thereof and praseodymium or the compound thereof with antimony, barium, tin, tantalum, tungsten, uranium, one of their compounds and mixtures thereof.

According to the invention, the erbium or compound thereof, the praseodymium or compound thereof and, if need be, the bismuth or compound thereof are, preferably, used in the form of powders dispersed in a matrix.

The subject-matter of the invention is thus also a radiation attenuating material that comprises a matrix in which a radiation attenuating composition is dispersed, the composition being in the form of a powder, and which is characterised in that said composition comprises:

30 to 70% by mass of erbium or of a compound thereof;

20 to 50% by mass of praseodymium or of a compound thereof; and 0 to 50% by mass of bismuth or of a compound thereof.

As mentioned previously, the erbium compound is typically an oxide and, in particular, the sesquioxide of erbium (III), of formula $Er_2O_3$.

Similarly, the praseodymium compound is typically an oxide, which is, preferably, selected from oxide of praseodymium(III), oxide of praseodymium(IV) and oxide of praseodymium(III-IV), of respective formulas $Pr_2O_3$, $PrO_2$ and $Pr_6O_{11}$, the oxide of praseodymium(III-IV) being quite particularly preferred.

When the radiation attenuating composition according to the invention comprises such oxides of erbium and of praseodymium, it comprises, preferably, 55 to 65% by mass of erbium oxide and 35 to 45% by mass of praseodymium oxide; better still, this composition comprises (60±2) % by mass of erbium oxide and (40±2) % by mass of praseodymium oxide.

When the radiation attenuating composition according to the invention comprises an erbium oxide, a praseodymium oxide and bismuth, it comprises, preferably, 30 to 45% by mass of erbium oxide, 20 to 30% by mass of praseodymium oxide and 30 to 45% by mass of bismuth; better still, it comprises 33 to 42% and, in a particularly preferred manner, (36±2) % by mass of erbium oxide, 22 to 28% and, in a particularly preferred manner, (24±2) % by mass of praseodymium oxide, and 30 to 45% and, in a particularly preferred manner, (40±2) % by mass of bismuth.

According to the invention, the respective proportions of the matrix and of the radiation attenuating composition in the material can vary to a large extent as a function of the use for which said material is intended and, in particular, the level of radiation attenuation sought within the context of said use.

This being so, it is generally preferred that the matrix represents 10 to 25% by mass of the mass of the material and that the radiation attenuating composition represents, for its part, 75 to 90% by mass of the mass of the material.

For the manufacture of radiation protection articles and, in particular, individual protective articles such as a protective overall, it is preferred that the matrix represents (15±2) % by mass of the mass of the material and that the radiation attenuating composition represents (85±2) % by mass of the mass of the material.

Furthermore, and so as to obtain a distribution of this composition that is the most homogeneous possible in the matrix, the radiation attenuating composition is, preferably, constituted of particles of which at least 90% by number have an average particle size less than or equal to 20 μm and, better still, less than or equal to 1 μm.

As for the matrix, it is also chosen as a function of the use for which the radiation attenuating material is intended.

Thus, for example, for the manufacture of an individual protective article of the type glove, overall, chasuble, jacket, skirt, oversleeve, thyroid protector, gonad protector, armpit protective clothing, ocular protection headband, operative field, curtain, sheet, the desired mechanical properties, the characteristics of flexibility and comfort of this article are oriented preferably towards a matrix based on a thermoplastic material, in particular, polyvinyl chloride, or based on an elastomeric material, selected in particular from natural rubber, synthetic polyisoprenes, polybutadienes, polychloroprenes, chlorosulphonated polyethylenes, polyurethane elastomers, fluorinated elastomers (or fluoroelastomers), isoprene-iso-butylene copolymers (or butyl rubbers), copolymers of ethylene-propylene-diene (or EPDM), sequenced copolymers of styrene-isoprene-styrene (or SIS), sequenced copolymers of styrene-ethylene-butylene-styrene (or SEBS), and mixtures thereof.

In a variant, for the manufacture of a group protective article of the type bedding, panel, protective screen, the search for characteristics of durability and resistance to wear of material leads preferably towards matrices of silicious type, in particular glass, matrices based on a thermosetting resin, selected in particular from resins of type epoxides, vinyl esters and unsaturated polyesters, or instead a material based on a thermoplastic, selected in particular from polyethylene, polypropylene, a polycarbonate, for example, bisphenol A polycarbonate, acrylonitrile-butadiene-styrene (or ABS) and products obtained by co-extrusion of ABS with compounds of (meth)acrylate type, such as polymethylmethacrylate (or PMMA).

The subject-matter of the invention is also an article providing protection against ionising radiation, comprising a radiation attenuating material as defined previously.

Preferably, the protective article is an individual protective article such as a glove, an overall, a chasuble, a jacket, a skirt, an oversleeve, a thyroid protector, a gonad protector, an armpit protective clothing, an ocular protection headband, an operating field, a curtain, a sheet, or a group protective article such as a bedding, a panel or a protective screen.

The invention has numerous advantages.

In fact, it makes it possible to produce materials and protective articles which have remarkable properties of attenuating ionising radiation, in particular X- and gamma-type electromagnetic radiation, of energy that can lie within a wide range, typically comprised between 0 and 100 keV, and does so, from metals and metal oxides which do not have any toxicity known to date for human health and the environment.

Moreover, the elimination of the waste stemming from their manufacture thus does not require any specific collection and treatment channel.

Finally, in a similar manner, the elimination of these materials and protective articles after use does not require any specific channel other than those that are imposed by a potential contamination by toxic or radioactive materials.

Other characteristics and advantages of the invention will become clearer on reading the complement of description that follows, which relates to examples of manufacture of materials according to the invention as well as a demonstration of the radiation attenuation properties of these materials.

Obviously, these examples are only given by way of illustration of the subject-matter of the invention and do not in any way constitute a limitation of said subject-matter.

DETAILED DESCRIPTION OF PARTICULAR EMBODIMENTS

Example 1

Figure 1:
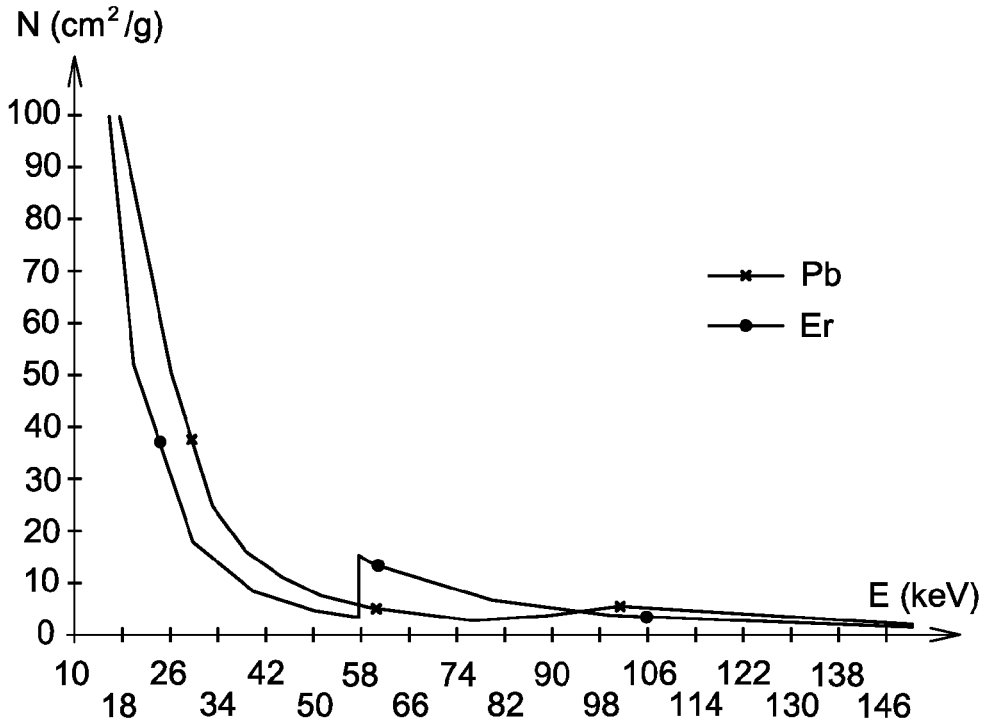
FIG. 1 is a comparative graphic representation of the mass attenuation coefficient, noted N, as a function of the photonic energy, noted E, in the case of the elements lead (curve marked by a pictogram representing a cross) and erbium (curve marked by a pictogram representing a disc).
Figure 2:
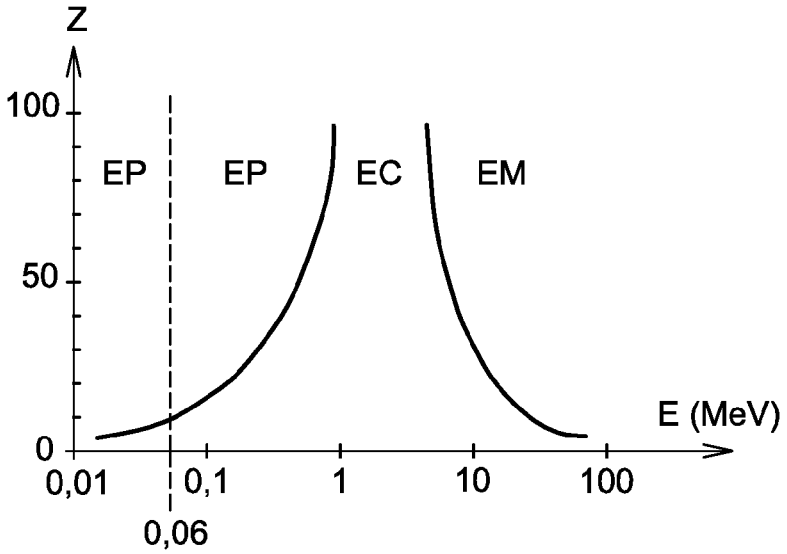
FIG. 2 represents the breakdown of the components of the interaction between photons from an ionising radiation, both as a function of the atomic number of the radiation attenuating element, noted Z, and of the photonic energy, noted E, the surface portions noted "EP", "EC" and "EM" representing respectively the observation domains of the photoelectric effect, of the Compton effect and of the materialization effect.
Figure 3:
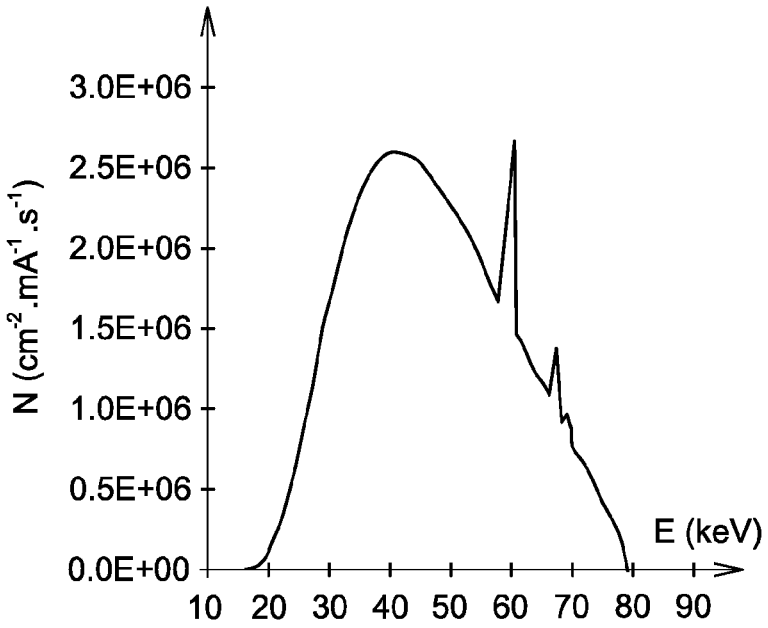
FIG. 3 (respectively, FIG. 4) represents the cross-section, noted N, of photons from an X-ray generator within which a potential difference of 80 kV (respectively, 140 kV) is applied, as a function of the photonic energy, noted E.
Figure 4:
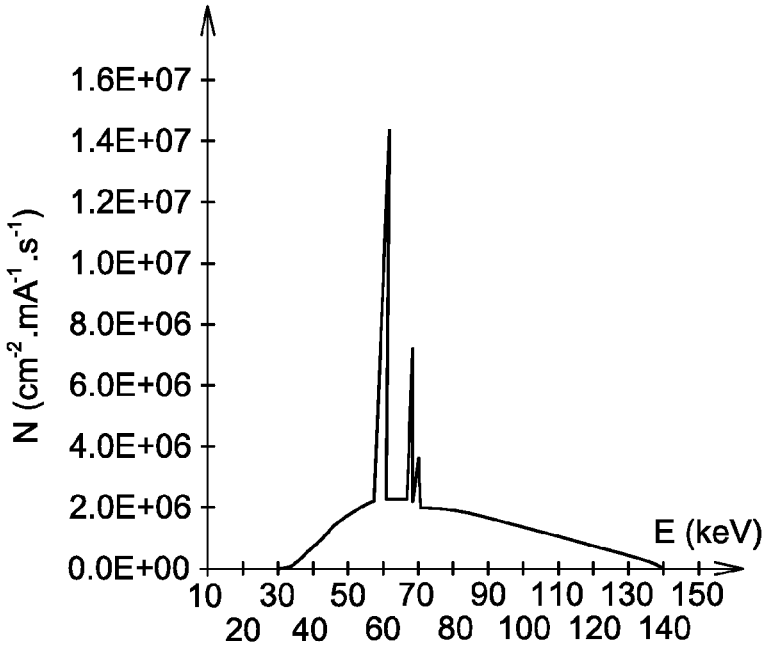
Figure 5:
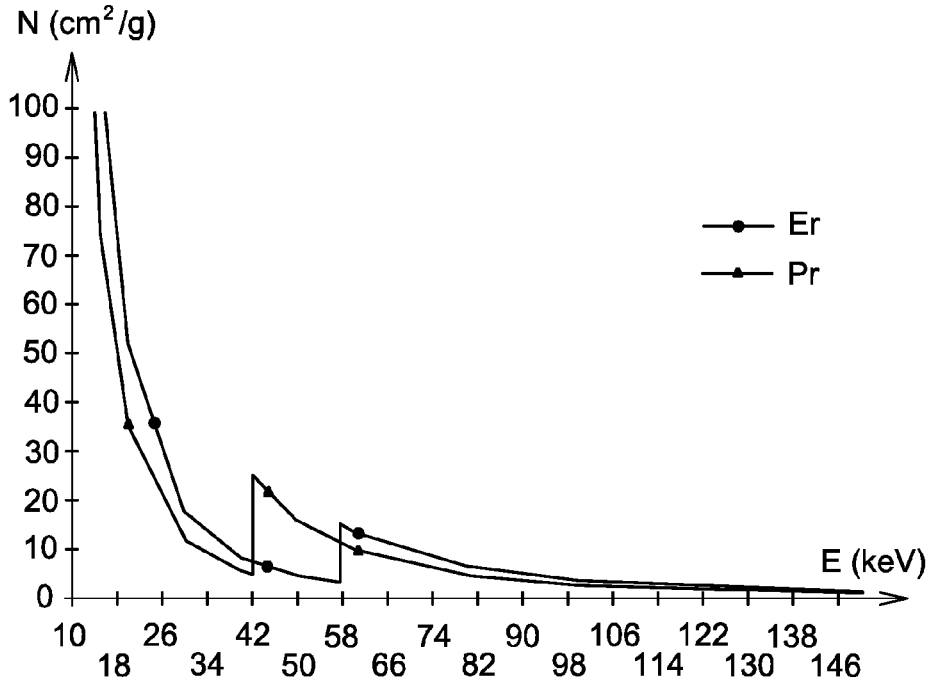
FIG. 5 is a comparative graphic representation of the mass attenuation coefficient, noted N, as a function of the photonic energy, noted E, in the case of the elements erbium (curve marked by a pictogram representing a disc) and praseodymium (curve marked by a pictogram representing a triangle).
Figure 6:
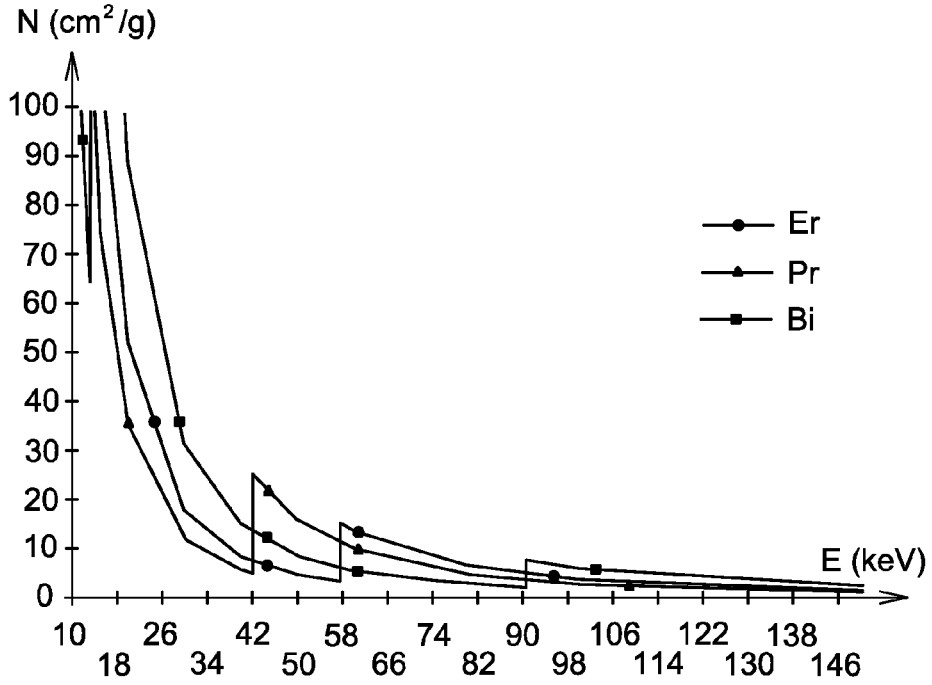
FIG. 6 is a comparative graphic representation reproducing the formalism and signalling used in FIG. 5, adding thereto the case of the element bismuth (curve marked by a pictogram representing a square).

Manufacture of Materials According to the Invention

Five samples, respectively E1, E2, E3, E4 and E5, of materials according to the invention were produced.

The samples E1, E2 and E3 correspond to materials that comprise a radiation attenuating composition composed of $Er_2O_3$ and of $Pr_6O_{11}$ whereas the samples E4 and E5 correspond to materials that comprise a radiation attenuating composition composed of $Er_2O_3$, of $Pr_6O_{11}$, and of bismuth in elementary form.

These samples, which are in the form of squares of approximately 30 centimeter sides, are produced by coating technique.

Moreover, these samples implement a radiation attenuating composition in the form of powders of which at least 90% of the particles constituting said powders have an average particle size less than or equal to 20 μm.

The characteristics specific to each of these samples are grouped together in Table 1.

TABLE 1

| | Sample | | | | |
|---|---|---|---|---|---|
| | E1 | E2 | E3 | E4 | E5 |
| Thickness (mm) | 4.6 | 2.3 | 5.2 | 1.6 | 3.2 |
| Basis weight ($kg/m^2$) | 13.4 | 5.8 | 13.8 | 4.8 | 9.6 |
| Base of the matrix | Silicone | PVC | PVC | Silicone | Silicone |
| Mass proportion composition/matrix (%/%) | 75/25 | 68/32 | 68/32 | 75/25 | 75/25 |
| Mass proportion $Er_2O_3/Pr_6O_{11}/Bi$ in the composition (%/%/%) | 60/40/0 | 70/30/0 | 70/30/0 | 36/24/40 | 36/24/40 |

Example 2

Radiation Attenuation Properties of Materials According to the Invention

The samples obtained in Example 1 above were subjected to tests intended to evaluate their capacity to attenuate X-type ionising radiation, which comes from X-ray generators within which a particular potential difference is applied, or of gamma-type, which are for example emitted by powders entering into the manufacture of nuclear fuels.

1. Radiation Attenuation Properties in the Presence of an X-Type Ionising Radiation The properties of attenuation of an X-type ionising radiation by materials according to the invention are evaluated by applying the provisions of the NF EN 61331-1 standard, entitled "*Protective devices against diagnostic medical X-radiation. —Part* 1: *Determination of attenuation properties of materials*".

The results as obtained with diverse potential differences are expressed in terms of theoretical lead equivalent thickness, noted $e_{theo(X)}$, and of measured lead equivalent thickness, noted $e_{exp(X)}$.

A gain factor is also defined, noted $F_X$, for a potential difference and particular weight proportions of $Er_2O_3/Pr_6O_{11}/Bi$ within the radiation attenuating composition, as being the ratio of $e_{exp(X)}$ to $e_{theo(X)}$.

When the ratio $F_X$ equals 1, the efficiency of a material is equivalent, in radiation attenuation terms, to that of a material of same basis weight but constituted uniquely of lead.

The results obtained for the samples E1, E2, E4 and E5 are shown in Table 2 below.

TABLE 2

| Potential difference (kV) | Sample | Mass proportion $Er_2O_3/Pr_6O_{11}/Bi$ (%/%/%) | $e_{theo(X)}$ (mm) | $e_{exp(X)}$ (mm) | $F_X$ (Ø) |
|---|---|---|---|---|---|
| 80 | E1 | 60/40/0 | 0.88 | 1.35 | 1.53 |
| | E2 | 70/30/0 | 0.35 | 0.43 | 1.22 |
| | E4 | 36/24/40 | 0.31 | 0.43 | 1.37 |
| | E5 | 36/24/40 | 0.63 | 1.03 | 1.63 |

TABLE 2-continued

| Potential difference (kV) | Sample | Mass proportion $Er_2O_3/Pr_6O_{11}/Bi$ (%/%/%) | $e_{theo(X)}$ (mm) | $e_{exp(X)}$ (mm) | $F_X$ (Ø) |
|---|---|---|---|---|---|
| 110 | E4 | 36/24/40 | 0.31 | 0.48 | 1.52 |
| | E5 | 36/24/40 | 0.63 | 1.02 | 1.61 |
| 150 | E2 | 70/30/0 | 0.35 | 0.40 | 1.14 |
| | E4 | 36/24/40 | 0.31 | 0.39 | 1.24 |
| | E5 | 36/24/40 | 0.63 | 0.76 | 1.19 |

Gain factors comprised between 1.14 and 1.63 are obtained with the materials according to the invention, which signifies that said materials have enhanced radiation attenuating properties compared to materials containing a radiation attenuating agent constituted uniquely of lead.

2. Radiation Attenuation Properties in the Presence of a Gamma-Type Ionising Radiation The properties of attenuation of a gamma-type ionising radiation by materials according to the invention are evaluated by means of a device implementing said materials, placed at a certain distance between, on the one hand, a radioactive source constituted of americium-241, which emits a gamma-type ionising radiation of 59 keV energy, and on the other hand, a spectrometer on which is assembled a germanium gamma detector.

The method employed consists in determining the attenuation of the gamma-type radiation from americium-241, by measuring the surface of the photoelectric absorption peaks recorded by the detector. This surface is compared, by the same method, to surfaces obtained with lead screens of known thickness.

As in the preceding paragraph 1, a theoretical lead equivalent thickness, noted $e_{theo(\gamma)}$, is defined and calculated from the basis weight of the materials tested, and from the density of lead in metal form. In other words, this thickness corresponds to the thickness of a material of same weight as the materials tested, but composed uniquely of lead.

A measured lead equivalent thickness, noted $e_{exp(\gamma)}$, is again defined.

A gain factor $F_\gamma$, corresponding to the ratio $e_{exp(\gamma)}/e_{theo(\gamma)}$, is also defined.

The results obtained for the samples E2 and E3 are shown in the Table 3 below.

TABLE 3

| Sample | Mass proportion $Er_2O_3/Pr_6O_{11}/Bi$ (%/%/%) | $e_{theo(X)}$ (mm) | $e_{exp(X)}$ (mm) | $F_Y$ (Ø) |
|---|---|---|---|---|
| E2 | 70/30/0 | 0.35 | 0.80 | 2.28 |
| E3 | 70/30/0 | 0.82 | 1.67 | 2.03 |

Gain factors greater than 2 are obtained with the materials according to the invention, which thus have enhanced radiation attenuating properties compared to materials containing a radiation attenuating agent uniquely constituted of lead.

Figure 7:
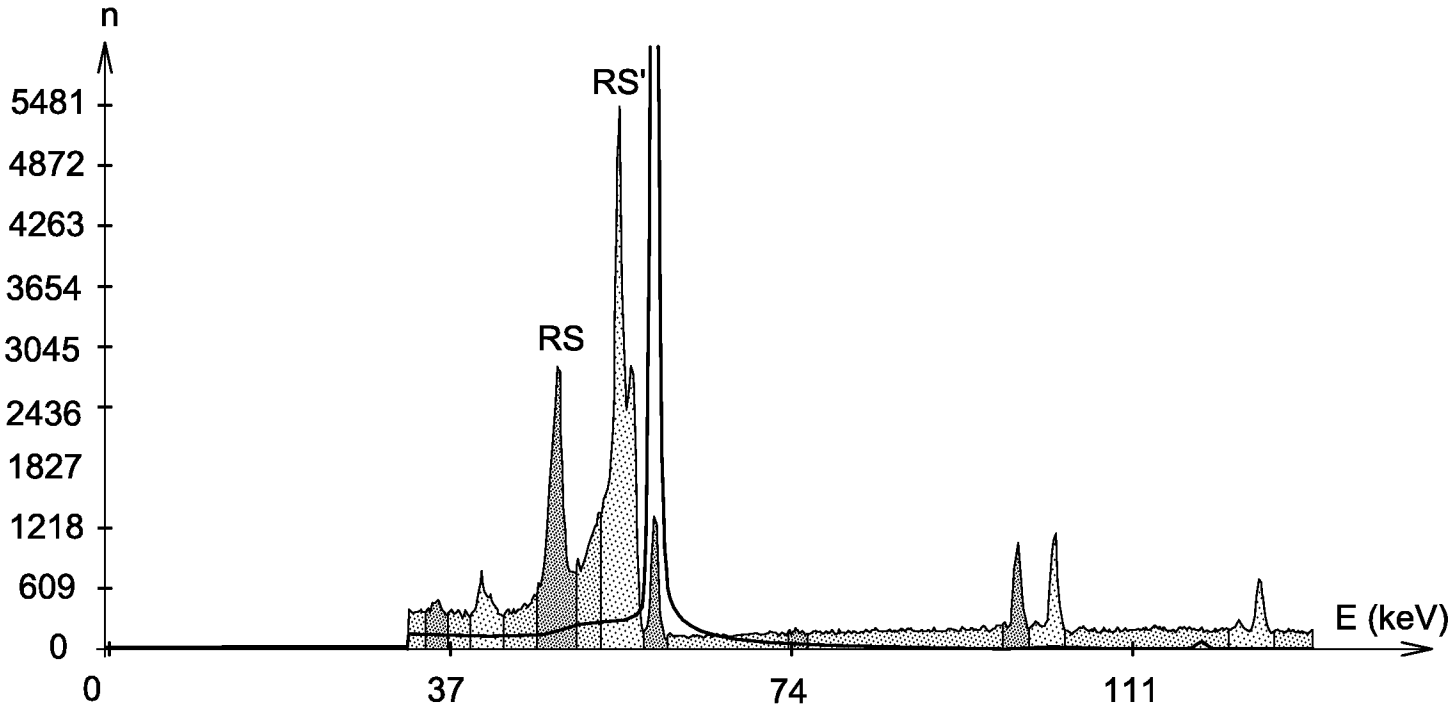
FIG. 7 represents, in thick line, the cross-section, noted n, of photons from a gamma-type ionising radiation emitted by americium-241, as a function of the photonic energy, noted E. The surface portions situated below the thin line curve represent the cross-section of photons from a material comprising erbium according to the invention, having received ionising radiation, as a function of the photonic energy.

A graphical representation of the cross-section, noted n, as a function of the photonic energy, noted E, is shown in FIG. 7.

The thick line curve, which represents the cross-section of photons from a gamma-type ionising radiation emitted by americium-241, as a function of the photonic energy, has a maximum corresponding to a high distribution of photons having an energy mainly centred on 59.6 keV.

By comparing the surface portions situated under the thin line curve, a strong attenuation of the radiation of energy mainly centred on 59.6 keV is observed.

Moreover, it is also possible to observe the emission of a secondary X-type radiation, which is materialized in the form of two rays noted "RS" and "RS'" in FIG. 7, and the respective energies of which are mainly centred on 49 and 55 keV.

As previously exposed, such a material according to the invention may be used for purposes of attenuation of radiation from MOX fuel.

In this respect, and as a complement, it may be added that, depending on the variability of the isotopic composition of this fuel, this being placed at a short distance from a measuring point, typically 50 centimeters, this gamma-type ionising radiation represents a proportion ranging from 75 to 85% of all the gamma- and X-radiation from the latter.

This high proportion makes all the more legitimate the implementation of a radiation attenuating composition as described above in the manufacture of protective articles against ionising radiation.

REFERENCES CITED

[1] International application PCT WO 2006/069007
[2] Patent application US 2008/0128658
[3] Patent application FR 2 948 672
[4] International application PCT WO 2005/017556
[5] Patent application DE 10 2006 958

The invention claimed is:

1. A method of attenuating radiation comprising the step of mixing the following compounds to form a mixture:

30 to 70% by mass of erbium or of a compound thereof;

20 to 50% by mass of praseodymium or of a compound thereof; and 0 to 50% by mass of bismuth or of a compound thereof;

wherein the method comprises the step of incorporating the mixture in a composition that attenuates radiation.

2. The method according to claim 1, characterised in that the erbium compound is an erbium oxide.

3. The method according to claim 2, characterised in that the erbium oxide is sesquioxide of erbium (III), of formula $Er_2O_3$.

4. The method according to claim 1, characterised in that the praseodymium compound is a praseodymium oxide.

5. The method according to claim 4, characterised in that the praseodymium oxide is oxide of praseodymium (III-IV), of formula $Pr_6O_{11}$.

6. The method according to claim 2, characterised in that the mixture comprises 55 to 65% by mass of erbium oxide and 35 to 45% by mass of praseodymium oxide.

7. The method according to claim 6, characterised in that the mixture comprises (60±2)% by mass of erbium oxide and (40±2)% by mass of praseodymium oxide.

8. The method according to claim 2, characterised in that the mixture comprises 30 to 45% by mass of erbium oxide, 20 to 30% by mass of praseodymium oxide and 30 to 45% by mass of bismuth.

9. The method according to claim 8, characterised in that the mixture comprises 33 to 42% by mass of erbium oxide, 22 to 28% by mass of praseodymium oxide and 30 to 45% by mass of bismuth.

10. Radiation attenuating material comprising a matrix in which a radiation attenuating composition is dispersed, said composition being in the form of a powder, characterised in that said composition comprises:

30 to 70% by mass of erbium or of a compound thereof;

20 to 50% by mass of praseodymium or of a compound thereof; and 0 to 50% by mass of bismuth or of a compound thereof.

11. Radiation attenuating material according to claim 10, characterised in that the erbium compound is an erbium oxide.

12. Radiation attenuating material according to claim 11, characterised in that the erbium oxide is sesquioxide of erbium(III), of formula $Er_2O_3$.

13. Radiation attenuating material according to claim 10, characterised in that the praseodymium compound is a praseodymium oxide.

14. Radiation attenuating material according to claim 13, characterised in that the praseodymium oxide is oxide of praseodymium(III-IV), of formula $Pr_6O_{11}$.

15. Radiation attenuating material according to claim 10, characterised in that the radiation attenuating composition comprises 55 to 65% by mass of erbium oxide, and 35 to 45% by mass of praseodymium oxide.

16. Radiation attenuating material according to claim 15, characterised in that the radiation attenuating composition comprises (60±2) % by mass of erbium oxide and (40±2) % by mass of praseodymium oxide.

17. Radiation attenuating material according to claim 10, characterised in that the radiation attenuating composition comprises 30 to 45% by mass of erbium oxide, 20 to 30% by mass of praseodymium oxide and 30 to 45% by mass of bismuth.

18. Radiation attenuating material according to claim 17, characterised in that the radiation attenuating composition comprises 33 to 42% by mass of erbium oxide, 22 to 28% by mass of praseodymium oxide, and 30 to 45% by mass of bismuth.

19. Radiation attenuating material according to claim 10, characterised in that the matrix represents 10 to 25% by mass of the mass of the material, whereas the radiation attenuating composition represents 75 to 90% by mass of the mass of the material.

20. Radiation attenuating material according to claim 10, characterised in that the matrix represents (15±2) % by mass of the mass of the material, whereas the radiation attenuating composition represents (85±2) % by mass of the mass of the material.

21. Radiation attenuating material according to claim 10, characterised in that the radiation attenuating composition is constituted of particles of which at least 90% by number have an average particle size less than or equal to 20 μm.

22. Article providing protection against ionising radiation, in particular X- and gamma-type electromagnetic radiation, comprising a radiation attenuating material according to claim 10.

23. Article providing protection according to claim 22, characterised in that it is a glove, an overall, a chasuble, a jacket, a skirt, an oversleeve, a thyroid protector, a gonad protector, an armpit protective clothing, an ocular protection headband, an operation area, a curtain, a sheet, a bedding, a panel or a protective screen.

* * * * *

UNITED STATES PATENT AND TRADEMARK OFFICE

CERTIFICATE OF CORRECTION

PATENT NO. : 9,006,695 B2
APPLICATION NO. : 14/369357
DATED : April 14, 2015
INVENTOR(S) : Noel Lantheaume It is certified that error appears in the above-identified patent and that said Letters Patent is hereby corrected as shown below:

In the specification, column 4, line 57, please replace “key” with -- keV --

Signed and Sealed this
Thirteenth Day of October, 2015

Michelle K. Lee

Michelle K. Lee
*Director of the United States Patent and Trademark Office*